US006501432B2

(12) United States Patent
Yuanzhu

(10) Patent No.: US 6,501,432 B2
(45) Date of Patent: Dec. 31, 2002

(54) PRIMARY RADIATOR CAPABLE OF ACHIEVING BOTH LOW REFLECTION AND LOW LOSS

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/922,326

(22) Filed: Aug. 3, 2001

(65) Prior Publication Data

US 2002/0021256 A1 Feb. 21, 2002

(30) Foreign Application Priority Data

Aug. 11, 2000 (JP) ..... 2000-244812

(51) Int. Cl.[7] ..... H01Q 13/00

(52) U.S. Cl. ..... 343/772; 343/785; 343/786; 343/872

(58) Field of Search ..... 343/772, 785, 343/786, 781 CA, 781 R, 872

(56) References Cited

U.S. PATENT DOCUMENTS 4,673,947 A * 6/1987 Newham ..... 343/781 CA
5,166,698 A * 11/1992 Ashhaugh et al. ..... 343/783
5,550,553 A * 8/1996 Yamaki et al. ..... 343/785
5,642,121 A * 6/1997 Martek et al. ..... 343/786
5,675,348 A * 10/1997 Okada et al. ..... 343/781 R
6,020,859 A * 2/2000 Kildal ..... 343/781 CA
6,353,418 B1 * 3/2002 Burger et al. ..... 343/786

FOREIGN PATENT DOCUMENTS

JP Hei 4-222101 8/1992
JP Hei 11-4103 1/1999

* cited by examiner

*Primary Examiner*—Tan Ho
(74) *Attorney, Agent, or Firm*—Brinks Hofer Gilson & Lione

(57) ABSTRACT

The present invention provides a primary radiator capable of achieving both loss reflection and low loss. A watertight cap made of a dielectric material having a relatively high dielectric constant is attached to an open end of a horn part continuing from a waveguide, a dielectric member made of a dielectric material having a lower dielectric loss than the watertight cap is disposed within the waveguide, and a projecting part integrally formed at an end of the dielectric member is extended to the inside of the horn part, whereby an end face of the projecting part is made to face the back of the watertight cap at a fixed interval.

2 Claims, 2 Drawing Sheets

PRIMARY RADIATOR CAPABLE OF ACHIEVING BOTH LOW REFLECTION AND LOW LOSS

BACKGROUND OF THE INVENTION

1. Field of the Invention

The present invention relates to a primary radiator attached to a satellite broadcast reflective antenna or the like.

2. Description of the Prior Art

FIG. 4 is a drawing showing the configuration of a conventional primary radiator, which comprises a circular waveguide 10 having a conical horn part 10*a* at one end thereof and a watertight cap 11 attached to an open end of the horn part 10*a*. The watertight cap 11, made of a dielectric material, comprises a dielectric part 11*a* covering the open end of the horn part 10*a* and a cylindrical projection part 11*b* projecting inside from a central part of the dielectric part 11*a*. The thickness t of the dielectric part 11*a* is set so as to provide a sufficient strength but is set thinner than the wavelength of radio waves propagating through it. The diameter d and height h of the projection part 11*b* are set to proper dimensions, and letting the wavelength of radio waves propagating through the projection part 11*b* be $\mu$, the height h is set between about $\frac{3}{8}\lambda$ and $\frac{1}{2}\lambda$.

The primary radiator configured in this way is placed in the vicinity of the focus position of a reflecting mirror of a satellite broadcast reflective antenna, and radio waves from a satellite, reflected on the reflecting mirror, travel from the horn part 10*a* to the waveguide 10 via the watertight cap 11. At this time, since the radio waves reflected on the surface and back of the dielectric part 11*a* are canceled by the projection part 11*b*, radio wave reflection in the watertight cap 11 is reduced so that a satisfactory reflection loss property is obtained. The open end of the horn part 10*a* covered with the watertight cap 11 having a sufficient strength prevents rainwater, dust, and the like from invading the horn part 10*a*.

Since a watertight cap is exposed to rain water and sunlight, it is desirable to make it of a dielectric material having excellent weatherability such as AES resin, ABS resin, and the like. However, this has been a problem in that, since this type of material generally has a high dielectric loss, in the case where the dielectric part 11*a* is formed integrally with the projection part 11*b* to constitute the watertight cap 11 as in the conventional example described above, although a satisfactory reflection loss property can be obtained, the watertight cap 11 having a high dielectric loss increases loss.

SUMMARY OF THE INVENTION

The present invention has been made in view of the above circumstances of the prior art and provides a primary radiator capable of achieving both low reflection and low loss.

To achieve the above object, a primary radiator of the present invention comprises: a waveguide having a horn part at one end thereof; a watertight cap attached to an open end of the horn part; and a reflection preventing member disposed within the horn part at a fixed interval from the watertight cap, wherein the reflection preventing member is made of a dielectric material having a lower dielectric loss than the watertight cap.

With this construction, since reflection in the watertight cap and reflection in the reflection preventing member cancel each other out, a satisfactory reflection loss property can be obtained, and since the reflection preventing member is made of a dielectric material having a lower dielectric loss than the watertight cap, dielectric loss due to the watertight cap is suppressed and low loss can be achieved.

In the above configuration, whether radio waves from a satellite are linearly polarized waves or circularly polarized waves, particularly in the case of a primary radiator that converts circularly polarized waves to linearly polarized waves, it is desirable to dispose a dielectric plate used as a 90-degree phase element within the waveguide and provide the reflection preventing member integrally with the dielectric plate, whereby a circularly polarized wave primary radiator with low reflection and low loss can be realized.

In the above configuration, an impedance conversion part having a stepwise gap whose depth is about one-fourth an in-tube wavelength is formed at each end of the dielectric plate and a reflection preventing member formed continuously to one impedance conversion part is formed projectingly to the inside of the horn part, whereby the overall length of the dielectric plate can be reduced and the primary radiator can be miniaturized.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
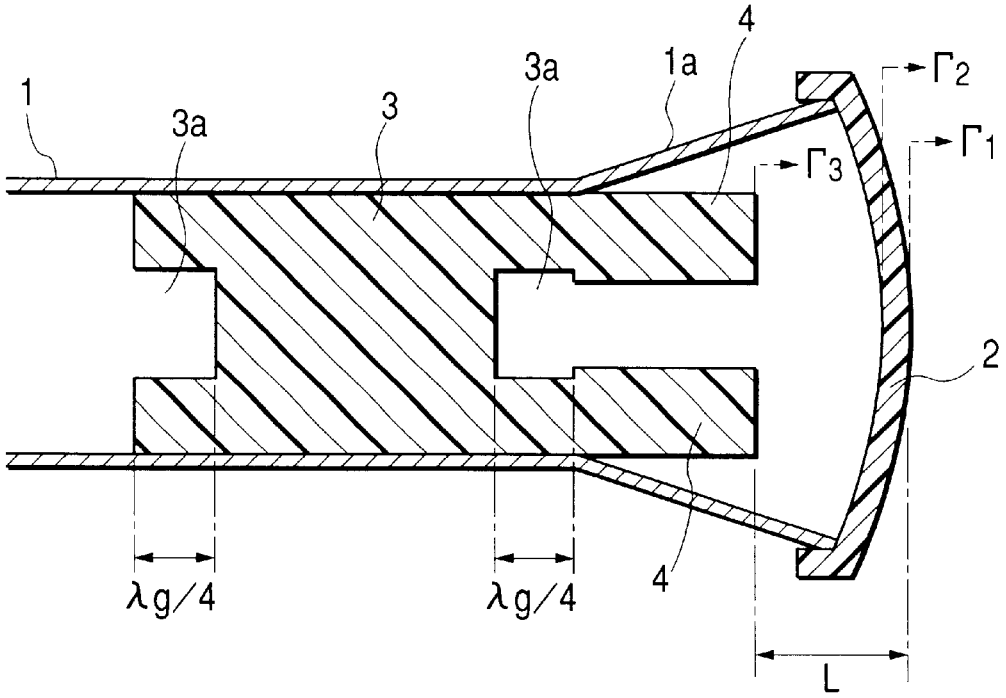
FIG. 1 is a drawing showing the configuration of a primary radiator according to an example embodiment of the present invention.

Hereinafter, an embodiment of the present invention will be described with reference to the accompanying drawings. FIG. 1 is a drawing showing the configuration of a primary radiator according to an example embodiment of the present invention.

As shown in FIG. 1, a primary radiator of this example embodiment comprises a circular waveguide 1 having a conical horn part 1*a* at one end thereof, a watertight cap 2 attached to an open end of the horn part 1*a*, and a dielectric member 3 disposed within the circular waveguide 1. The watertight cap 2 is made of a dielectric material having excellent weatherability such as AES resin, ABS resin, and the like; in this embodiment example, a dielectric material having a dielectric constant $\epsilon$ of 3.5 is used. The watertight cap 2 has a uniform thickness t of 0.7 mm. The dielectric member 3 is made of a dielectric material having a lower dielectric loss than the watertight cap 2; in this embodiment example, polyethylene having a dielectric constant $\epsilon$ of 2.25 is used. Since the dielectric member 3 functions as a 90-degree phase element, it is secured to the inside wall of the waveguide 1. Square notches 3*a* are formed at central portions of both ends of the dielectric member 3 in the direction of the length thereof, and these notches 3*a* form stepwise gaps as impedance conversion parts. The depth of the notches 3*a* is set to about one fourth an in-tube wavelength $\lambda g$, and a bifurcated projecting part 4 as a reflection preventing member is integrally formed at an end of the dielectric member 3 in the form that sandwiches one notch 3*a*. That is, the projecting part 4 extends to the horn 1*a* from the dielectric member 3, and within the horn part 1*a*, an end face of the projecting part 4 faces the surface of the watertight cap 2 at a fixed interval L.

In the primary radiator configured in this way, when a circularly polarized wave sent from a satellite is inputted to the primary radiator, the circularly polarized wave invades the horn part 1*a* via the watertight cap 2 and propagates through the dielectric member 3 from the projecting part 4 before being converted to a linearly polarized wave. Specifically, since the circularly polarized wave is a polarized wave that a synthetic vector of two linearly polarized waves that have the same amplitude and are 90 degrees out of phase with each other is rotating, when the circularly polarized wave passes through the dielectric member 3, the phase shift of 90 degrees is canceled so as to have the same phase, so that the circularly polarized wave is converted to the linearly polarized wave. Accordingly, if the linearly polarized wave is received coupled to a probe (not shown) disposed within the waveguide, the receive signal can be outputted after being frequency-converted to an IF frequency signal by a converter circuit.

Figure 2:
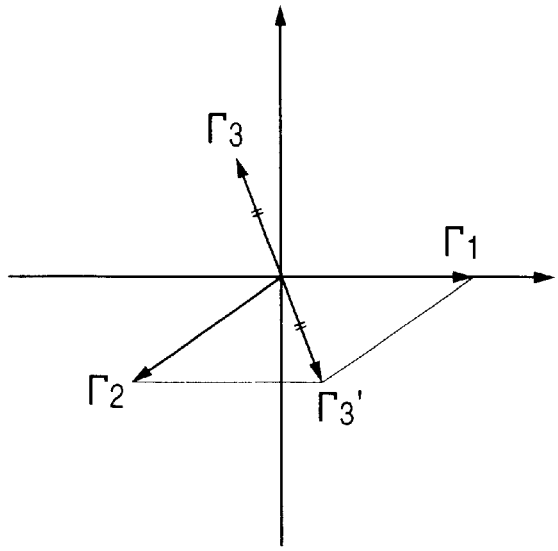
FIG. 2 illustrates vectors of reflection in a watertight cap and a reflection preventing member.

If a vector of reflection in the surface of the watertight cap 2 is $\Gamma_1$, a vector of reflection in the back of the watertight cap 2 is $\Gamma_2$, and a vector of reflection in an end face of the projecting part 4 is $\Gamma_3$, as shown in FIG. 2, L dimension is set so that $\Gamma_3$ is in a relationship of 180 degrees with respect to a synthetic vector $\Gamma_3'$ of $\Gamma_1$ and $\Gamma_2$. As a result, since the reflection in the watertight cap 2 and the reflection in the projecting part 4 cancel each other out and the reflection of radio waves in the watertight cap 2 is greatly reduced, a satisfactory reflection loss property can be obtained. Also, since the projecting part 4 is made of a dielectric material having a lower dielectric loss than the watertight cap 2, dielectric loss by the watertight cap 2 is suppressed and low loss can be achieved, and since the projecting part 4 is formed integrally with the dielectric member 3, the overall structure of the primary radiator can be simplified. Furthermore, since the notch 3*a* whose depth is about one fourth an in-tube wavelength is formed at each end of the dielectric member 3, the length of an impedance conversion part required at each end of the dielectric member 3 can be shortened, so that the primary radiator can be miniaturized.

Figure 3:
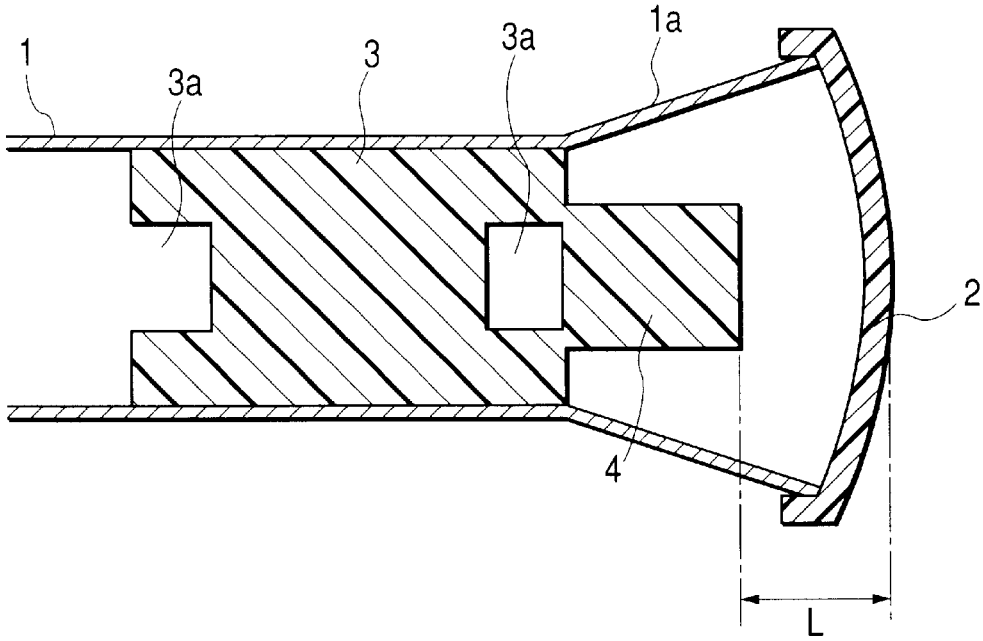
FIG. 3 illustrates a variant of the reflection preventing member.
Figure 4:
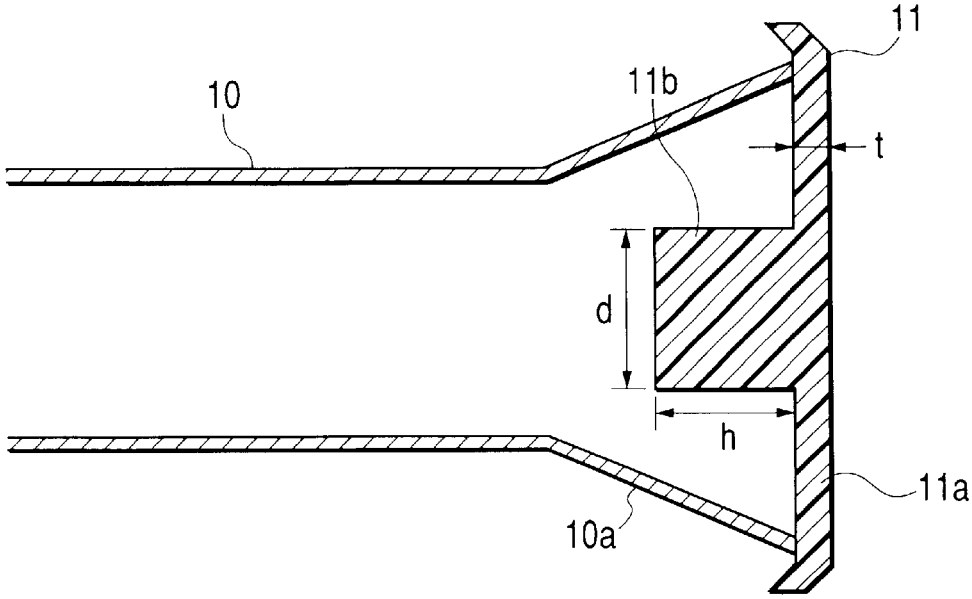
FIG. 4 PRIOR ART
FIG. 4 is a drawing showing the configuration of a conventional primary radiator.

As the projecting part 4 used as a reflection preventing member, without being limited to the above embodiment example, for example, as shown in FIG. 3, a rectangular projecting part 4 maybe integrally formed so as to block the notch 3*a* at a central portion of one end of the dielectric member 3, or a reflection preventing member may be formed separately from the dielectric member 3. What is necessary is that a reflection preventing member made of a dielectric material having a lower dielectric loss than the watertight cap 2 is disposed within the horn part 1*a* at a fixed interval from the watertight cap 2.

Although the case where radio waves inputted to the primary radiator are circularly polarized waves has been described in the above embodiment example, the present invention is also applicable to primary radiators to which linearly polarized waves are inputted. In this case, the dielectric member 3 used as a 90-degree phase element is not required and only a reflection preventing member may be disposed within the horn part at a fixed interval from a watertight cap.

The present invention is implemented in such a configuration as has been described above, and has effects described below.

If a reflection preventing member may be disposed within the horn part at a fixed interval from a watertight cap, and the reflection preventing member is made of a dielectric material having a lower dielectric loss than the watertight cap, since reflection in the watertight cap and reflection in the reflection preventing member cancel each other out, a satisfactory reflection loss property can be obtained. Moreover, dielectric loss due to the watertight cap is suppressed and low loss can be achieved.

What is claimed is:

1. A primary radiator, comprising:

a waveguide having a horn part at one end thereof;

a watertight cap attached to an open end of the horn part; and a reflection preventing member disposed within the horn part at a fixed interval from the watertight cap, wherein the reflection preventing member is made of a dielectric material having a lower dielectric loss than the watertight cap, and wherein a dielectric plate used as a 90-degree phase element is disposed within the waveguide and the reflection preventing member is provided integrally with the dielectric plate.

2. The primary radiator according to claim 1, wherein an impedance conversion part having a stepwise gap whose depth is about one-fourth an in-tube wavelength is formed at each end of the dielectric plate, and the reflection preventing member is formed continuously to the impedance conversion part and is forced projectingly to the inside of the horn part.

* * * * *

UNITED STATES PATENT AND TRADEMARK OFFICE

CERTIFICATE OF CORRECTION

PATENT NO. : 6,501,432 B2
DATED : December 31, 2002
INVENTOR(S) : Dou Yuanzhu

It is certified that error appears in the above-identified patent and that said Letters Patent is hereby corrected as shown below:

Column 4,
Line 48, delete "forced" and substitute -- formed -- in its place.

Signed and Sealed this

Eighth Day of April, 2003

JAMES E. ROGAN
*Director of the United States Patent and Trademark Office*